US007939153B2

(12) United States Patent
Lenkl

(10) Patent No.: US 7,939,153 B2
(45) Date of Patent: May 10, 2011

(54) APPLICATOR HEAD FOR AN APPLICATOR DEVICE

(75) Inventor: Johannes Lenkl, Freising (DE)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/506,294

(22) PCT Filed: Feb. 27, 2003

(86) PCT No.: PCT/EP03/02033

§ 371 (c)(1),
(2), (4) Date: Aug. 31, 2004

(87) PCT Pub. No.: WO03/074367

PCT Pub. Date: Sep. 12, 2003

(65) Prior Publication Data

US 2005/0115682 A1 Jun. 2, 2005

(30) Foreign Application Priority Data

Mar. 1, 2002 (DE) ..... 202 03 307 U

(51) Int. Cl.
*B65C 9/14* (2006.01)

(52) U.S. Cl. ..... 428/43; 428/131; 428/138; 269/21; 279/3

(58) Field of Classification Search ..... 156/538–542, 156/556, 566; 269/21; 428/43, 138; 279/3; 248/363; 414/793, 797
See application file for complete search history.

(56) References Cited

U.S. PATENT DOCUMENTS

| | | | | | |
|---|---|---|---|---|---|
| 2,492,908 | A | * | 12/1949 | Von Hofe | 156/538 |
| 3,377,096 | A | * | 4/1968 | Wood | 294/64.1 |
| 3,613,208 | A | * | 10/1971 | Seberg et al. | 29/896.6 |
| 3,888,725 | A | * | 6/1975 | French | 156/556 |
| 4,049,484 | A | * | 9/1977 | Priest et al. | 156/285 |
| 4,284,689 | A | * | 8/1981 | Craighead et al. | 428/620 |
| 4,392,913 | A | * | 7/1983 | Baumli | 156/584 |
| 4,526,648 | A | * | 7/1985 | Tochtermann | 156/497 |
| 5,024,574 | A | * | 6/1991 | Wilson et al. | 414/416.05 |
| 5,753,072 | A | * | 5/1998 | Taylor | 156/493 |
| 5,885,406 | A | | 3/1999 | Tiefel | |
| 5,971,051 | A | | 10/1999 | Crankshaw | |
| 6,182,957 | B1 | * | 2/2001 | Becker | 269/21 |

* cited by examiner

*Primary Examiner* — Mark A Osele

(57) ABSTRACT

An applicator head for a device with an air suction source for applying individual flat materials elements to objects. The applicator head has an applicator surface in air communication with the air suction source and has perforatable, weak locations. The weak locations can be selectively perforated and, when perforated, a weak location can function as a suction intake opening.

25 Claims, 4 Drawing Sheets

APPLICATOR HEAD FOR AN APPLICATOR DEVICE

CROSS-REFERENCE TO RELATED APPLICATIONS

This application is a National Phase Patent Application of International Application Number PCT/EP03/02033, filed on Feb. 27, 2003, which claims priority of German Patent Application Number 202 03 307.4, filed on Mar. 1, 2002.

FIELD OF THE INVENTION

The present invention concerns an applicator head for applying individual flat material elements, in particular labels, to objects.

BACKGROUND

Applicator devices serve to apply or mount flat material elements, in particular labels, to an object. In the case of applicator devices of that nature, it is important that the applicator head holds the flat material element to be applied securely during the application procedure. This is particularly important to avoid displacement of the applicator head from a starting position, in which it picks up the flat material element to be applied, to the application location, in which the flat material element is applied to the object. In some conventional applicator devices, a suction air flow is used for holding the flat material element to the applicator head. Two different kinds of suction air applicator devices are common in these conventional devices.

The first type of suction air applicator device includes a fan that produces a suction air flow. The fan is disposed in the interior of the housing portion of the applicator device, which also accommodates a control system and a hydraulic or pneumatic displacement means of the applicator device. The applicator head has openings therethrough in its applicator surface. The flat material element is held to the applicator head by the suction air produced by the fan.

This first type of suction air applicator device, however, does not operate in a fault-free manner when dealing with flat material elements that are small and/or difficult to apply. In addition, this type of applicator device requires secondary air.

A second type of suction air applicator device is an injector applicator device. Injector applicator devices operate on the basis of the venturi principle. The applicator head is again provided with a plurality of openings therethrough, wherein an injector is disposed in the interior of the housing of the applicator device, and compressed air is jetted into the injector. This causes the air to be dragged out of the applicator head, thereby reducing air pressure in the head, so that the flat material element is held to the applicator head.

The second type of injector applicator device suffers from the disadvantage that fault-free operation is only possible when all openings in the applicator head are covered by the flat material element. A suitable applicator head, therefore, has to be produced for each form of a flat material element, which is disproportionately costly.

OBJECT

The object of the present invention is to provide an applicator head which, in a simple manner, permits adaptation of the applicator surface of the applicator head to flat material elements of different kinds of shape and/or size.

SUMMARY

By virtue of the possibility of perforating one or both of at least two weak locations of a material provided on the applicator surface in order to provide one or more suction openings, the applicator surface can be readily adapted to differing shapes and/or varying sizes of flat material elements. The weak locations are preferably arranged regularly on the applicator surface so that applicator heads for flat material elements of different shapes and/or varying sizes can be provided by perforating the desired weak locations in the applicator surface.

It is also possible to provide different applicator heads with a single applicator surface in a particularly simple manner if the weak locations in the material are arranged regularly, preferably in a raster grid configuration, that is to say distributed over the entire applicator surface, preferably in columns and rows.

If the applicator surface is produced from a plastic material, in particular polyethylene, static charges can occur upon detachment of the flat material element from the applicator surface. Those static charges in turn impede pushing a fresh flat material element on to the applicator surface. In addition, it is difficult when using a plastic material, in particular a PE-material, to produce the applicator surface with a material thickness which is regular throughout. In order to permit the latter and/or to avoid static charging of the applicator surface, it is further advantageous if the outside of the applicator surface is provided with grooves which preferably extend in mutually parallel relationship at an equidistant spacing. It is also advantageous if the grooves are provided between two columns of weak locations in the material.

To avoid replacement of the complete applicator head each time a different shape and/or size of flat material elements are to be processed, the applicator surface can be provided on an applicator pad which is replaceably joined to the applicator head.

The applicator head may be reversibly displaceable in a straight line from a starting position in which it receives, for example, the flat material element into an applicator position in which it applies the flat material element to an object. In this case, it is advantageous if the applicator head has a pad receiving means into which the applicator pad can be reversibly inserted in a direction transverse to the direction of displacement of the applicator head.

The pad receiving means can be configured in several different ways. It may, for example, be formed by two C-shaped guide rails that extend parallel to each other and into which the applicator pad can be reversibly inserted.

In order to achieve a clearly defined end position when inserting the applicator pad into the pad receiving means, an abutment may be provided on the pad receiving means, and which defines an end position.

To prevent the applicator pad from coming loose from its end position during the applicator process, the applicator pad may be releasably locked on the applicator head by a locking device. In that case, the locking device can be formed by a spring-loaded ball, which is provided on the applicator head or the applicator pad, and which is capable of reversibly engaging into a recess on the applicator pad or the applicator head.

A particularly simple structure can be achieved if the abutment is formed by the locking device.

The applicator pad itself can, in turn, be constructed from a variety of different elements. For example, the applicator pad may be formed from a carrier plate and an applicator plate including the applicator surface, the plates preferably forming at least one hollow space between them. In that case, the carrier plate can be made from aluminum and the applicator plate can be made from a deformable material, in particular a plastic material such as PE or polyethylene.

The weak locations of the material can, in turn, be formed by a variety of solutions and/or elements. In one embodiment, the weak locations can be recesses or depressions in the applicator plate. In that case, the remaining material, that is to say the bottom of the depression, can be perforated by means of a suitable tool. In that case, the component portions of the material that are displaced in the perforating operation would project from the applicator plate. Therefore it has proven to be advantageous if, at each weak location at the applicator surface, preferably a depression in the applicator plate, at the other side or surface of the applicator plate that extends in parallel relationship with the applicator surface, there are provided corresponding material weak locations, preferably recesses, which are aligned with the material weak locations at the applicator surface and which are preferably separated from each other by a 'membrane', that is to say a thin material skin portion. In other words, the thin material skin portion is disposed within the applicator plate so that, in the perforation operation, component portions of the thin material skin portion do not project beyond the applicator plate.

As noted above, static charges can occur at the applicator surface, which make it difficult to fit a fresh flat material element thereon, or difficult to detach a flat material element that is already disposed on the applicator surface. Grooves can be provided in the applicator surface to prevent this from happening. Alternatively, or in addition, the applicator plate may have an applicator surface that is of a thickness, measured substantially perpendicularly to the applicator surface, to permit material removal. Such material can be removed to form a defined applicator surface that is adapted to a specific flat material element. Material removal can be effected, for example, by a milling operation in a plane parallel to the applicator surface. The applicator surface area can thus be reduced in relation to the area of the total applicator plate. The applicator surface area can thus be approximately matched to the shape of the flat material element so that the latter does not have to be pushed over a surface region of the applicator plate or applicator surface, which region is not occupied by the flat material element by virtue of the configuration thereof. The problem of static charging can thereby be reduced.

The applicator plate and the carrier plate can be connected to each other both releasably and non-releasably. A non-releasable connection can be achieved by means of an adhesive connection of the carrier plate to the applicator plate. Alternatively, the applicator plate and the carrier plate can be connected together by a screw connection. In the latter case, care is to be taken to ensure that the joining area between the applicator plate and the carrier plate is air-tight.

To make a communication between the applicator pad and the suction air source, the carrier plate may be provided with a coupling for releasable communication with the suction air source. In that case, the coupling can be formed by a preferably circular opening in the carrier plate which, when the applicator pad is mounted to the applicator head, is connected to a tube portion.

Further advantageous configurations and embodiments of the invention by way of example are described hereinafter with, reference to the accompanying drawings.

DETAILED DESCRIPTION OF THE INVENTION

Figure 1:
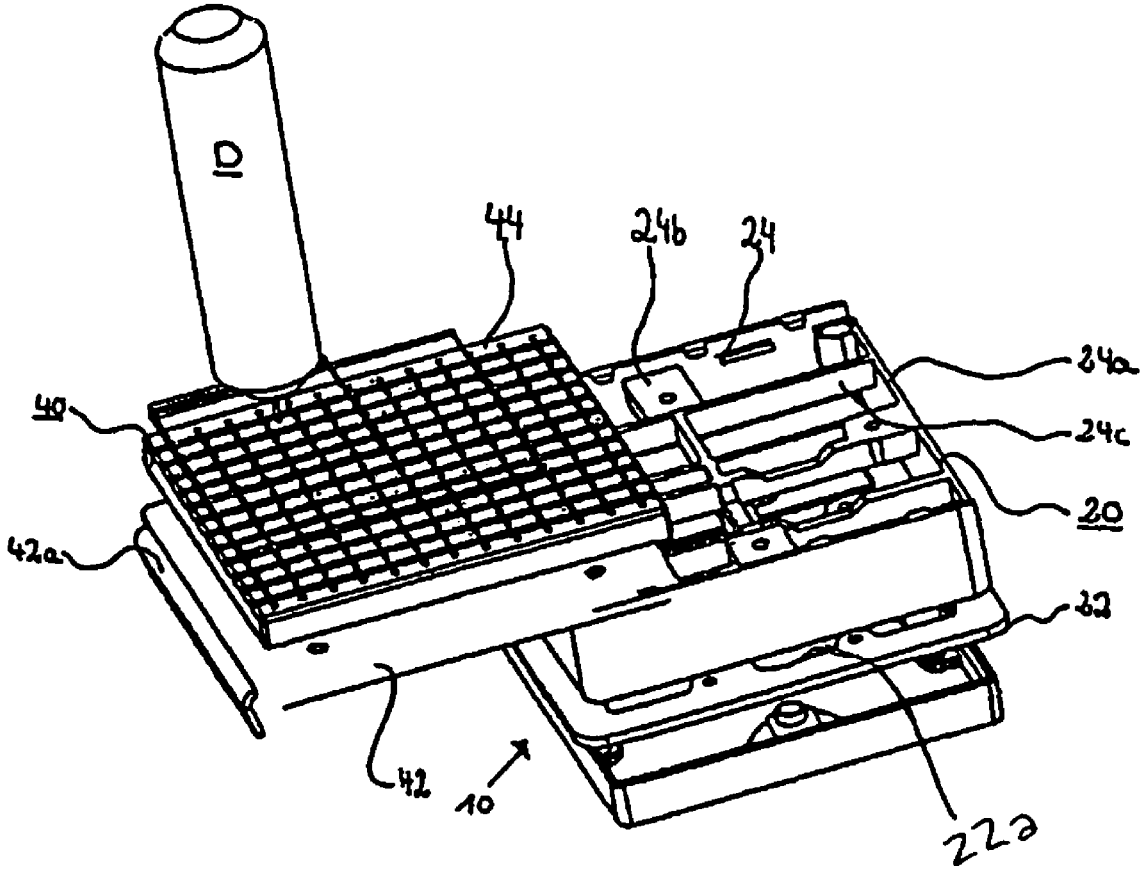
FIG. 1 shows a diagrammatic perspective view of one embodiment of an applicator head according to the invention, together with a tool for perforating weak locations in an applicator surface of the head.

According to a first embodiment of the invention shown in FIG. 1, an applicator head 10 has a mounting frame 20 for releasably mounting the applicator head 10 to a housing portion of an applicator device (not shown), in which is arranged a suction air source (not shown), for example in the form of an injector, and an applicator pad 40 which can be reversibly pushed on to the mounting frame 20 in a manner described in further detail below.

The mounting frame 20 in this embodiment has a basically square shape and is made up of a square base plate 22 and a square frame element 24. As can be seen in particular from FIG. 4, the base plate 22 is provided with openings 22*a* through which the air flow produced by the suction air source can flow from the applicator pad 40 through the mounting frame 20 to the suction air source.

Figure 2:
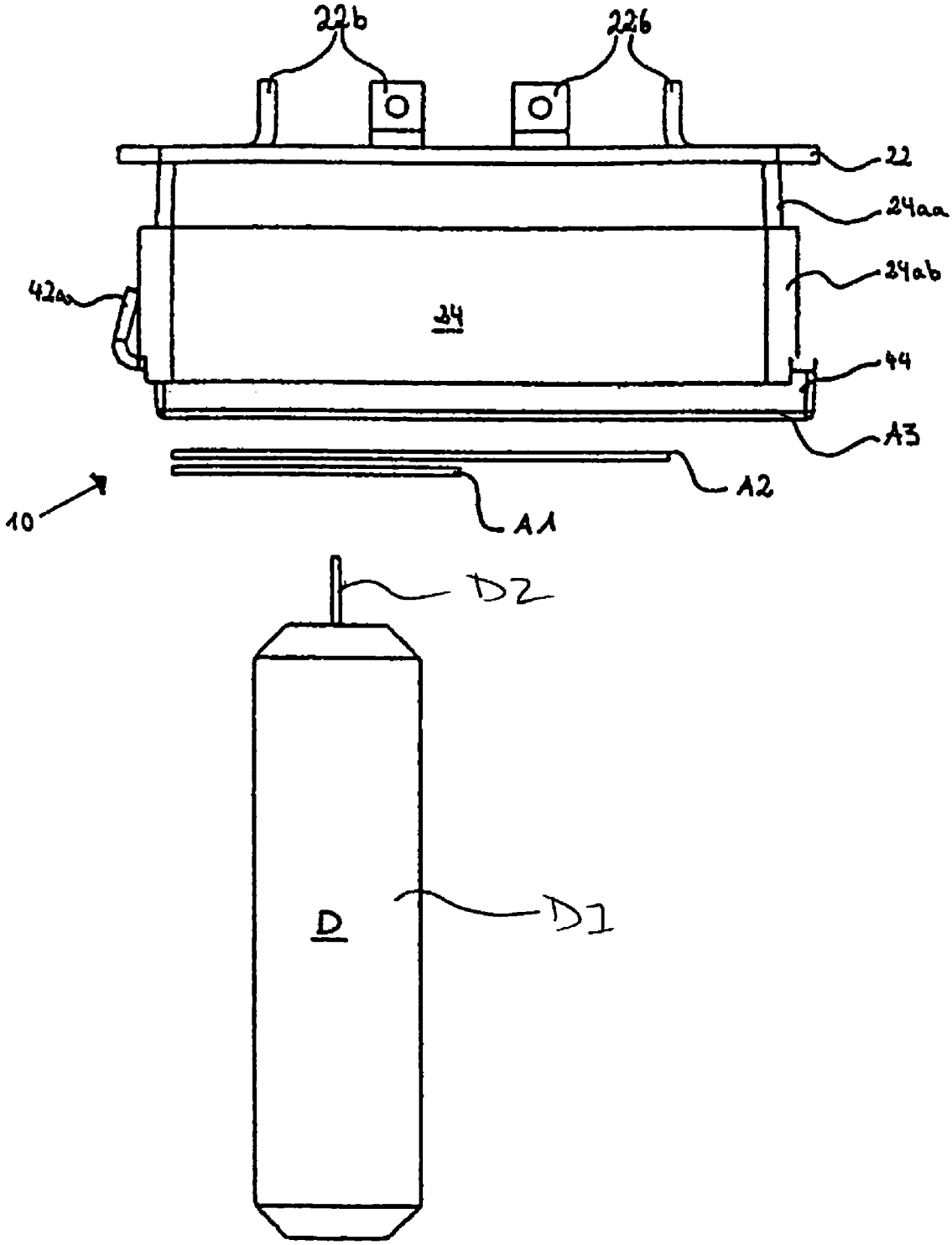
FIG. 2 shows a side view of the applicator head illustrated in FIG. 1 with the perforating tool.
Figure 4:
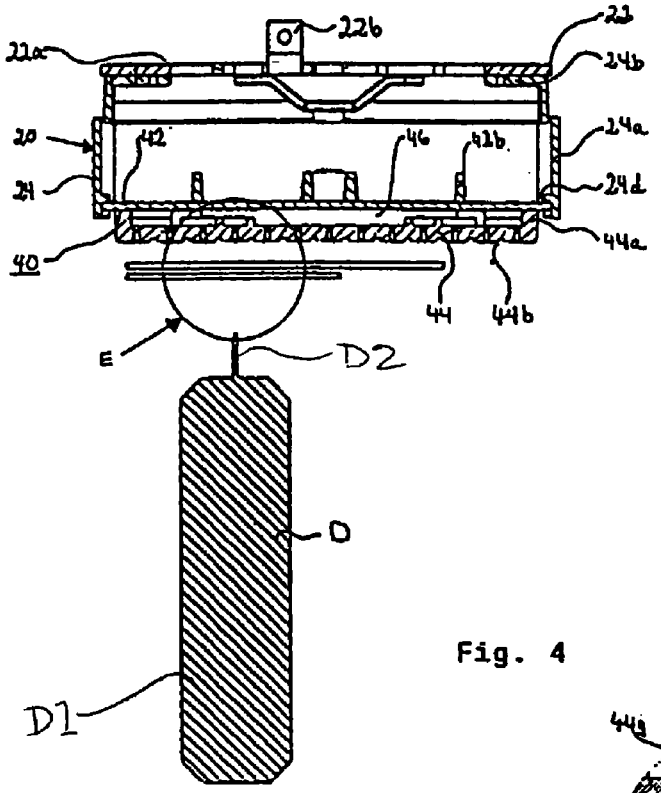
FIG. 4 shows a cross-sectional view along line IV-IV in FIG. 3.

On the side of the base plate 22 facing away from the frame element 24 are fixing bars 22*b*, by means of which the mounting frame 20 and the applicator pad 40, can be releasably mounted to the applicator device (see FIGS. 2 and 4). The applicator pad 40 can be pushed onto the mounting frame 20. The fixing bars 22*b* can be formed, for example, by disengaging portions of the base plate 22 and bending them over through about 90°. Removal of the portions from the surface of the plate produces the through openings 22*a*.

The square area that is defined by the frame element 24 approximately corresponds to the area of the base plate 22, so that the peripheral wall 24*a* of the frame element 24, which forms the frame, delimits the base plate 22 at its edges. As can be seen in particular from FIG. 4*a*, the peripheral frame wall 24*a* has two wall portions, a first wall portion 24*aa* and a second wall portion 24*ab*. The first wall portion 24*aa*, which faces towards the base plate 22, defines a square area that is somewhat smaller than the base plate 22. The second frame portion 24*ab*, adjoins the first wall portion 24*aa* and faces away from the base plate 22. The second frame portion 24*ab* encompasses a square area that is larger than the base plate 22. The two wall portions 24*aa* and 24*ab* are integrally connected together by way of a step.

On its side facing towards the base plate 22, the frame element 24 is provided with inwardly directed connecting bars or connecting flanges 24*b*, by means of which the frame element 24 is preferably non-releasably secured to the base plate 22, for example by adhesive, soldering or riveting.

As can further be seen from FIG. 1, the frame element 24 has in its interior a plurality of stiffening ribs 24*c*, which serve, inter alia, to maintain the stability in respect of shape of the frame element 24. As shown in FIG. 4, at the edges facing away from the base plate 22 of two mutually parallel wall sides, the frame element 24 can also be provided with guide elements 24*d*, which form a pad receiving means for the applicator pad 40 and into which the applicator pad 40 can be inserted. The guide elements 24*d* are each formed by a respective C-shaped projection 24*d*, which extends over the full length of the corresponding frame wall and faces into the interior of the frame element 24. If the applicator head 10 is not of a square shape but, for example, a rectangular shape, then the guide elements 24*d* preferably extend at the edges of the peripheral frame walls 24*a* that form the long sides of the rectangle.

The base plate 22 and the frame element 24 can be produced from the same or different materials. It is preferable for the mounting frame to be produced throughout from aluminum or an alloy thereof.

The applicator pad 40 includes a carrier plate 42, which is preferably produced from aluminum or an alloy thereof, and an applicator plate 44, which is preferably made from an easily deformable or severable material, in particular a plastic material, preferably polyethylene. The carrier plate 42 and the applicator plate 44 are preferably non-releasably connected together, for example by adhesive.

The carrier plate 42 is also substantially square and has an area that is congruent with that of the area of the base plate 22. If the width or length of the area enclosed by the second wall portion 24*ab* is greater than the base plate 22 and the carrier plate 42, the spacing of the two guide projections 24*d* and in particular the spacing between the base limbs of the guide projections 24*d*, that connect the two free limbs of each C-shaped projection 24*d* together can correspond to the width and length of the carrier plate 42. In some embodiments, the spacing of the two free limbs of each C-shaped projection 24*d* approximately corresponds to the thickness of the carrier plate 42, or is slightly larger. As a result, the carrier plate 42 of the applicator pad 40 can be inserted into the mounting frame 20 along the guide projections 24*d* and be securely held there.

To facilitate moving the applicator pad 40 into a specific position relative to the mounting frame 20, the carrier plate 42 is provided with an abutment 42*a* (FIGS. 1-4) at its edge that faces in opposite relationship to the insertion direction. The abutment 42*a* in this embodiment is formed by a bent edge portion of the carrier plate 42, which, in the assembled condition, faces the direction of the mounting frame 20 and preferably extends over the full length of the bent edge. The insertion direction is perpendicular to the surface normal to the applicator plate 44, that is to say, in parallel relationship with the applicator plate 44. When the specific, end position is reached, the abutment 42*a* bears against the wall portion 24*ab* of the frame wall 24*a* and thus delimits the insertion movement.

As shown in FIG. 4, the carrier plate 42 has stiffening ribs 42*b* at its side facing towards the mounting frame 20. The stiffening ribs 42*b* promote shape stability of the carrier plate 42. The carrier plate 42 is also provided with at least one through opening (not shown) through which the air flow produced by the suction air source can flow from the applicator plate 44 to the suction air source.

The applicator plate 44 is of a basic square shape, the area dimensions of which are smaller than those of the carrier plate 42 so that edges of the carrier plate 42 remain free and the carrier plate 42 can be inserted into the guide projections 24*d*. In addition, on its side facing towards the carrier plate 42, the applicator plate 44 has an edge flange or rim portion 44*a* that extends from the periphery of the applicator plate 44 towards the carrier plate 42. After the applicator plate 44 is mounted to the carrier plate 42, for example by being glued thereto, a hollow space 46 is formed by that rim portion 44*a*, as can be seen from FIG. 4. In this embodiment, the connection between the carrier plate 42 and the applicator plate 44 is sealed and in particular is air-tight.

Figure 3:
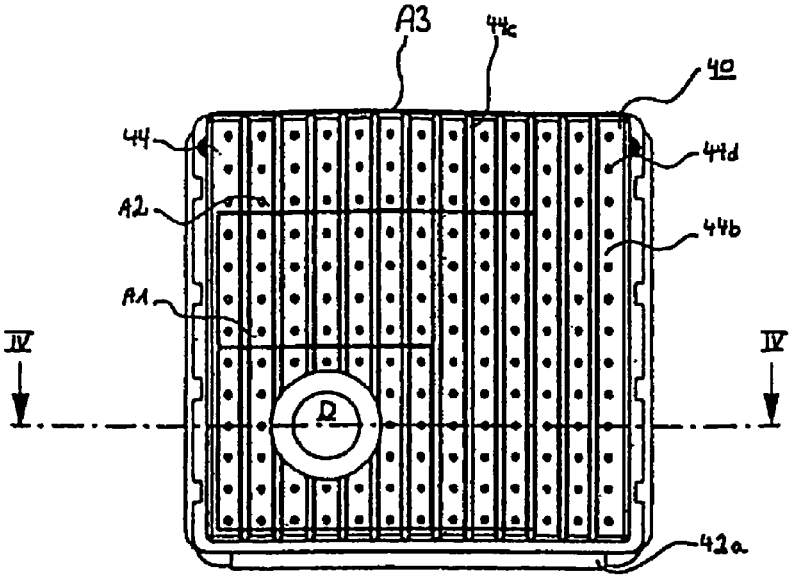
FIG. 3 shows a plan view of the applicator surface of the applicator head shown in FIG. 1.

As seen in FIGS. 3 and 4, the side 44*b* of the applicator plate 44, which faces away from the carrier plate 42, forms an applicator surface to which the flat material element to be applied, such as a label, is held during the application procedure. That applicator surface 44*b* is provided with a plurality of grooves 44*c*, which extend in mutually parallel relationship at equidistant spacing.

Figure 5:
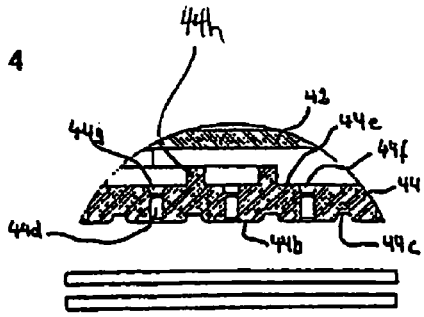
FIG. 5 shows the detail E in FIG. 4 on an enlarged scale.
Figure 5:
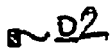

Weak locations 44*d* (also referred to herein as wells) are also provided in the applicator plate 44 in raster grid configuration at equidistant spacings in the spaces between two successive grooves 44*c*, or a groove 44*c* and the associated edge of the applicator plate 44. Those weak locations 44*d* are formed by circular depressions, as can be seen from FIG. 4. As shown in more detail in FIG. 5, at the side 44*e* of the applicator plate 44 that faces towards the carrier plate 42 the applicator plate 44 is provided in a manner corresponding to the material weak locations 44*d*, with further material weak locations 44*f* (again, also referred to herein as wells), which are also circular depressions. The material weak locations 44*d*, 44*f* which are oriented in mutually coaxial relationship are separated by a thin material skin or wall portion 44*g*, which extends in transverse relationship to their axial direction. The thin material skin portions 44*g* exclude a flow communication between the two material weak locations 44*d*, 44*f* which belong to each other, in particular after production of the applicator head 10 in the factory. In other words, the applicator head 10 or the applicator pad 40 which can be replaceably inserted into the applicator head 10 cannot initially be used after manufacture as there is no flow communication between the applicator surface 44*b* and the suction air source.

Depending on the respective wish of the user of the applicator head 10 according to the invention, however, one or more thin material skin portions 44*g* can be perforated by means of the perforating tool D shown in FIGS. 1, 2 and 4, as a consequence of the deformable material of the applicator plate 44, so that the material weak locations 44*d*, 44*f* form an outlet opening which is in communication with the suction air source by way of the hollow space 46 and the mounting frame 20 with the openings 22*a*. In that way it is possible to form operational applicator surfaces of any desired configuration, the shape and size of which depend on the shape and size of the flat material element to be applied. FIGS. 2 and 3 show examples of different applicator surfaces A1, A2, A3 which are all square but of different sizes. The applicator surface A3 corresponds to the full applicator surface 44*b* afforded by the applicator plate 44. In other words, in the case of the applicator surface A3, all thin material skin portions 44*g* of the material weak locations 44*d*, 44*f* have to be perforated, whereas, in the case of the applicator surface A1, only about one third of the material weak locations 44*d*, 44*f* have to be perforated. It will be appreciated that it is also possible to produce other shapes, such as for example rectangles, rhombuses, and so forth by means of the raster arrangement of the material weak locations 44*d*, 44*f*.

The perforating tool D can include a handle portion, at one end of which can be centrally mounted a perforating needle D2, as can be seen from FIGS. 2 and 4. It will be appreciated, however, that it is also possible to use any other suitable tool for perforating the thin material skin portions 44*g*.

Figure 6:
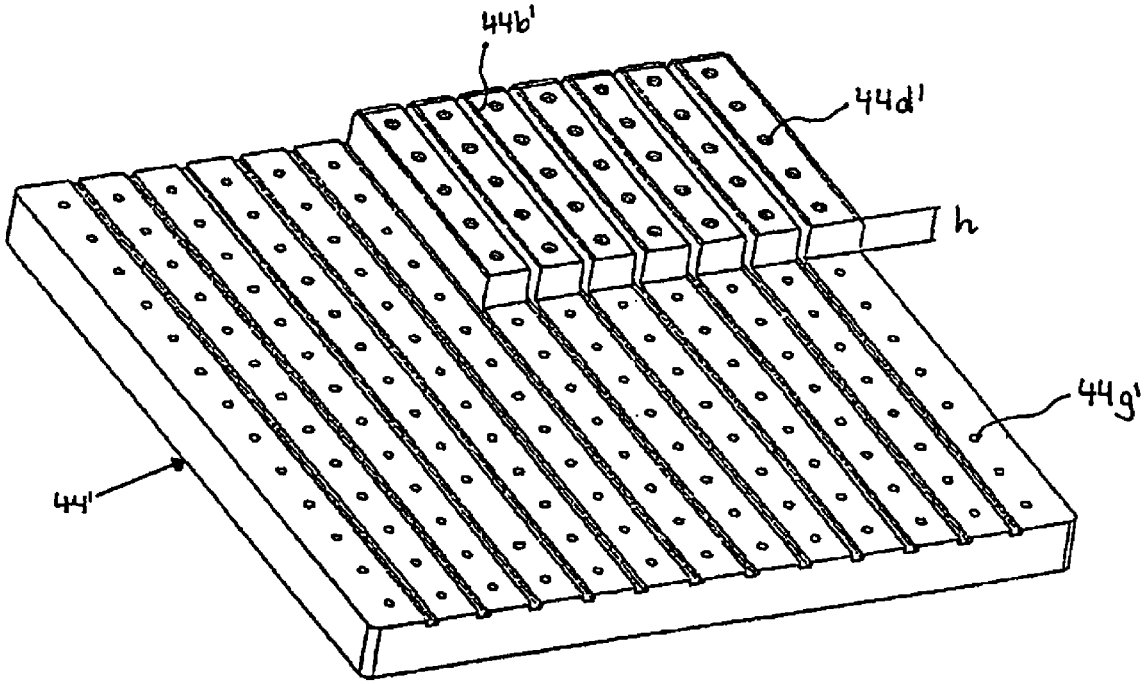
FIG. 6 shows a perspective view of a second embodiment of an applicator plate which can be received in the applicator head shown in FIG. 1.

FIG. 6 shows a second embodiment of the applicator plate 44'. This embodiment is of a predetermined material thickness that makes it possible to remove material in a plane parallel to the applicator surface 44*b'*. In that way, the applicator plate 44' can be provided with an applicator surface 44*b'* whose thickness at least approximately corresponds to the size of the flat material element or label. The removal of material can be effected, for example, by a milling operation. In that respect, the thickness h of material to be milled away can be selected to reach approximately the depth of the recesses 44*d'* as far as the thin material skin portion 44*g'*. That ensures that no secondary air issues from the weak locations 44*d'* that are possibly opened in the milling operation.

Referring to FIGS. 1-6, the applicator head 10 can be produced by first providing a mounting holder 20. At the same time, or after the applicator pad 40 is produced, the carrier plate 42 is air-tightly joined to the applicator plate 44 by, for example, an adhesive. All thin material skin portions 44*g* of the weak locations 44*d*, 44*f* of the applicator pad 40 are intact at this stage. Then, the applicator pad 40 is inserted into the guide projections 24*d* of the mounting holder 20 until the applicator pad 40 is locked to the mounting holder 20 and/or the abutment 42*a* bears against the outside of the frame wall 24. Then, individual thin material skin portions 44*g* corresponding to the shape of the flat material element to be applied can be perforated by means of the perforating tool D, either at the factory at which the applicator head 10 is produced, or by the customer.

Before or at this point, the applicator plate 44 or 44' can be machined by means of a milling tool. In one embodiment, a part of the applicator plate 44' projects in raised relationship, forming the applicator surface 44*b'*.

A plurality of alternate applicator pads 40 may be provided to apply different flat material elements with one and the same applicator head 10. By virtue of the interchangeability of the applicator pad 40 with respect to the mounting holder 20, it is then possible for applicator pads 40 involving applicator surfaces that are perforated in different ways, for example the applicator surfaces A1, A2, and A3, to be selectively mounted to the applicator head 10.

Although the foregoing describes the invention in terms of embodiments, the embodiments are not intended to cover all modifications and alternative constructions falling within the spirit and scope of the invention, which is limited only by the plain meaning of the words as used in the appended claims.

The invention claimed is:

1. An applicator head for a device having an air suction source for applying labels to objects, comprising:

an applicator surface for connection to said air suction source and having spaced perforatable weak locations which can be selectively perforated to provide holes in a desired configuration;

an applicator pad coupled to the applicator surface; and a mounting frame releasably connected to the applicator pad;

wherein the mounting frame includes two C-shaped guide rails that extend in parallel relationship' and into which the applicator pad can be reversibly inserted.

2. An applicator head for a device having an air suction source for applying labels to objects, comprising:

an applicator surface for connection to said air suction source and having spaced perforatable weak locations which can be selectively perforated to provide holes in a desired configuration;

an applicator pad coupled to the applicator surface; a mounting frame releasably connected to the applicator pad; and an abutment means positioned to hold the applicator pad in place relative to the mounting frame.

3. An applicator head for a device having an air suction source for applying individual flat material elements to objects, the applicator head comprising:

an applicator surface connected to said air suction source and having at least two perforatable, weak locations being recesses having a bottom which can be perforated by a suitable tool;

an applicator pad coupled to the applicator surface;

a mounting frame releasably connected to the applicator pad;

the applicator pad is formed from a carrier plate and an applicator plate; and a second surface parallel to the applicator surface, the second surface having at least two further weak locations which are aligned with the weak locations at the applicator surface, wherein the further weak locations are separated from the weak locations by a thin material skin.

4. An applicator head as in claim 3, having a plurality of wells formed in the applicator plate, each well having opposing first and second ends, said first end being an open end arranged at one of a first or second side of the applicator plate and the second being a closed end spaced apart from the first end wherein the wells are regularly arranged.

5. An applicator head as in claim 4, wherein the wells are distributed over the entire applicator plate.

6. An applicator head as in claim 5, wherein the wells are arranged in columns.

7. An applicator head as in claim 4, further comprising grooves formed in the first side of the applicator plate.

8. An applicator head as in claim 4, wherein:

the carrier plate is coupled to a second side of the applicator plate.

9. An applicator head as in claim 4, wherein the first and second closed end has a selectively perforatable wall, the perforatable thin walls of material are perforatable by a tool having a handle, said tool puncturing through the thin walls of material.

10. An applicator head as in claim 9, wherein when the perforatable thin wall of material is perforated at least a majority portion thereof is removed from obstructing fluid communication through the wells.

11. An applicator as in claim 9, wherein at least one of the closed ends remain unperforated.

12. An applicator as in claim 11, wherein the thin wall of material comprising the closed end of at least one of the plurality of wells is perforated.

13. An applicator head as in claim 4, wherein the wells are arranged in a raster grid configuration.

14. An applicator head as in claim 4, wherein the wells are arranged in rows and columns.

15. An applicator head for an applicator device as in claim 3 wherein the applicator pad is releasably lockable to the mounting frame of a locking device.

16. An applicator head as in claim 15, wherein the locking device comprises a spring-loaded ball.

17. An applicator head as in claim 15, wherein an abutment means is formed by the locking device.

18. An applicator head as in claim 3, wherein the applicator plate and the carrier plate are non-releasably connected together.

19. An applicator head as in claim 3, wherein the carrier plate is provided with a coupling for releasable attachment with the suction air source.

20. An applicator head as in claim 3, wherein the applicator plate is comprised of a deformable material.

21. An applicator head as in claim 20, wherein the deformable material is plastic.

22. An applicator head as in claim 3, wherein the carrier plate and the applicator plate define at least one hollow space between them.

23. An applicator head as in claim 3, wherein the applicator plate and the carrier plate are glued together.

24. An applicator head for a device having an air suction source for applying labels to objects, said applicator head comprising:

a unitary applicator plate having a first side adapted for facing a label to be applied to an object, a second side adapted for operative fluid communication with the air suction source, and a thickness separating the first and second sides from one another: and, a plurality of wells formed in the applicator plate, each well having opposing first and second ends, said first end being an open end arranged at one of the first or second sides of the applicator plate and the second end being a closed end spaced apart from the first end such that a depth of the well is less than the thickness of the applicator plate;

wherein each closed end comprises a selectively perforatable thin wall of material integral with the applicator plate, such that when perforated, fluid communication is established between the first and second sides of the applicator plate through the well having the perforated wall, and when unperforated, the wall of material obstructs fluid communication between the first and second sides of the applicator plate through the well having the unperforated wall: and, wherein the plurality of wells includes a first well having its open end arranged on the first side of the applicator plate and a second well having its open end arranged on the second side of the applicator plate, said first and second wells sharing a common selectively perforatable thin wall of material at their respective closed ends.

25. An applicator as in claim 24, wherein the first and second wells are essentially coaxial with one another.

* * * * *